United States Patent [19]

Hofsäss

[11] 4,317,097

[45] Feb. 23, 1982

[54] HEAT SWITCH

[76] Inventor: Peter Hofsäss, Strietweg 45, D-7530 Pforzheim, Fed. Rep. of Germany

[21] Appl. No.: 145,253

[22] Filed: Apr. 30, 1980

[30] Foreign Application Priority Data

Apr. 30, 1979 [DE] Fed. Rep. of Germany ..... 2917557

[51] Int. Cl.[3] ..... H01H 61/00

[52] U.S. Cl. ..... 337/89; 337/343; 337/365

[58] Field of Search ..... 337/53, 89, 343, 362, 337/365, 369, 370, 372, 380

[56] References Cited

U.S. PATENT DOCUMENTS

| | | | |
|---|---|---|---|
| 3,061,699 | 10/1962 | Epstein | 337/85 |
| 3,430,177 | 2/1969 | Audette | 337/365 |
| 4,149,138 | 4/1979 | Devzner et al. | 337/372 |
| 4,157,525 | 6/1979 | Grable | 337/365 |

*Primary Examiner*—George Harris

*Attorney, Agent, or Firm*—Craig & Antonelli

[57] ABSTRACT

A heat switch which includes a base body having electrical connection elements fixed thereon and insulated from each other, a movable contact member, a fixed contact member, and a bimetallic member for controlling relative positions of the contact members with respect to each other. Each of the contact members is connected with a respective one of the electrical connection elements in an electrically conductive manner. The bimetallic member is operable for conductively connecting or separating the contact members from each other. The movable contact member is relatively resistant to bending and is connected by an electrically conducting articulated connection with one of the electrical connection elements. The articulated connection includes an articulation part formed on one of the connection elements and a movable articulation part formed on the movable contact member. The articulation parts are rotationally slidably and electrically conductively applied against each other and resiliently pressed toward each other by a spring force.

18 Claims, 4 Drawing Figures

HEAT SWITCH

BACKGROUND AND SUMMARY OF THE INVENTION

The present invention relates to a switch arrangement and, more particularly, to a heat switch which includes a base body, connection elements, insulated from one another and fixed to the base body, a movable contact member, at least one fixed contact member, and a bimetal switch member whereby the contact members are connected so as to be electrically conductive with the respective connection elements and, at a predetermined change of temperature, the contact members may be connected or separated from each other by the bimetal switching member.

Heat switches of the aforementioned type are employed in a host of electrical instruments such as, for example, electric heating apparatus, electric motors, transformers, etc. to monitor the temperature of the instrument in question and especially to prevent damage which may be caused by unacceptable heating, i.e. ore heating.

In principle, switches of the aforementioned type function in such a manner that, at a specific change of temperature, i.e. a temperature rise above a predetermined temperature or a temperature drop below a predetermined temperature, the bimetal member, preferably constructed in a conventional manner as a bimetal snap plate, changes its configuration and thereby the movable contact member is actuated in such a way that a circuit that is to be monitored is opened or closed. In most applications the device is so constructed that in a low temperature setting the movable contact member is applied to the fixed contact and the circuit therefore is closed, and in a high temperature setting the circuit is interrupted so that there is no further delivery of energy to the apparatus or instrument being controlled. After the temperature returns below the predetermined temperature the circuit correspondingly is closed again. However, it is also possible to provide a switching arrangement in which, for example, a signal circuit is closed at the high temperature setting and, with a number of fixed contact members, both functions may be combined.

Heat switches of the aforementioned type have been constructed in many varied constructions. From practical experience, the simplest form of such a heat switch is one in which the fixed contact member is constituted by a simple rigid contact tongue and the movable contact member is formed by the bimetal member itself. While this construction is inexpensive, there is a disadvantage in that such a construction lacks precision in its response time since the bimetal member has the current that is to be switched passing through it, so that in any case only low currents can be switched.

To avoid the above-noted disadvantage, in German Pat. No. 21 21 802, a heat switch arrangement is proposed wherein a movable contact member is provided and is adapted to be actuated by a bimetal member through which no current or in any case a low current passes. In this arrangement, there is provided a spring snap plate with a contact piece forming a movable contact, said spring snap plate being actuated by a bimetal snap plate. The connection element and fixed contact member of this proposed heat switch arrangement are constituted by parts of the housing. In this arrangement, the spring snap plate must have a lower spring force than that of the bimetal snap plate in order to enable it to be actuatable thereby, and consequently, it has to have a relatively small cross section so that strong or large currents cannot be switched by this switch.

In German Pat. No. 17 90 103 another heat switch arrangement is proposed wherein a fixed contact member with each connecting element and a movable contact member is made as a bridge that is adapted to be actuated by a bimetal plate and held in its respective position by an annular spring. In this arrangement, the movable contact member can be made with a relatively large conducting cross section. However, a disadvantage of this arrangement resides in the fact that the manufacturing of this switch arrangement requires a relatively great outlay of material and labor. Additionally, the resultant heat switch is rather large.

Accordingly, an object of the invention is to solve the problem of producing a heat switch of the above-described type which is compact, but allows the switching of large currents.

A further object is to produce a heat switch that can be manufactured with a minimum outlay for labor and material.

The above objects are achieved according to a preferred embodiment of the invention by providing a heat switch with a movable contact member that is formed so as to be relatively stiff in bending and is connected by an electrically conducting articulated connection with a connection element, the articulated connection comprising a fixed part shaped on the connection element and a movable joint part shaped on the contact member, and the joint parts being rotationally slidable and applied so as to be electrically conductive and pressed against each other by spring force.

In contrast to known heat switches, in the heat switch according to the present invention the movable contact member is not actuated by way of its elastic deformability, but instead is achieved by an articulated connection to the connection element that allows a through-passage of electrical current. Moreover, the relatively stiff movable contact member can be made without difficulty with a cross section that is selected to carry the necessary electric current that is to be switched. The same is true with respect to the connection element and fixed contact member.

Also, it is advantageous, in accordance with the preferred embodiment, if the articulation parts themselves are shaped in the simplest way on the connection element and the movable contact member, respectively, and are pressed against each other by the force of a spring, so that both a kinematic holding together and low transmission resistance are ensured. Since the articulation connection in any case develops low friction forces, but no elastic recall force, actuation can be effected in the simplest way with the conventional bimetal member formed, advantageously, by a bimetal snap plate. Thereby, it is also possible to achieve uncomplicated, space-saving heat switch construction.

The articulation parts advantageously comprise cylindrical surface sections with concentric application surfaces that are respectively formed on the connection element and the movable contact member, respectively. Of these concentric application surfaces, one surface is convex and the other surface has the same curvature, but is concave. Preferably, the connection element and the contact member are stamped and bent as sheet parts so that the articulation parts can be made in a simple manner as cutouts from a cylindrical surface of suitable radius, and bent.

Actuation of the movable contact member by the bimetal member, in accordance with the present invention, is effected in that the bimetal member is connected along an edge by positive engagement of, for example, suitable projections, recesses, etc., with a free end of the movable contact member, while the base body presents a bearing for the edge region of the bimetal member located opposite the movable contact member.

In accordance to further features of the invention, to create unequivocal relationships for the flow of force, it is generally recommended that a bracing for the middle zone of the bimetal member be provided. In an embodiment that is particularly advantageous, in consideration of function and outlay for construction, the bracing is provided on the articulated connection, especially on the articulation part of the movable contact member, so that the bimetal member also exerts the spring force with which the articulation parts are pressed against each other.

An especially space-saving, readily mounted construction is produced by constructing the fixed contact member with a plane surface and so as to present a central recess. As a result, the fixed contact member can be stamped and bent in a simple manner together with the connection element as an integral sheet form, whereby the actual contact member with the recess forms a closed square. In such a construction, the contact element of the movable contact member extends, with an inner connection extension that is likewise shaped in one piece, essentially in a plane of the fixed contact member and inside its recess where, in consideration of insulation and dielectric strength, suitable distances are obviously to be maintained.

A still further advantageous feature is achieved by the recess of the fixed contact member being so made that, at the same time, a fastening element (such as a rivet or the like) also runs in an electrically insulated manner, through the recess with which the connection element of the movable contact member is connected with the base body. The fixed contact member and/or its connection element may be cast or impressed directly into the base body, and it also has been found to be beneficial if the base body is provided with positive-engaging shapes in the form of projections, depressions, etc., that are engaged by the fixed contact member and that engage the connection extension to the movable contact member so as to achieve an unequivocal fixing of the components of the switch that simplifies assembly, and at the same time counteracts leakage currents.

The fixed articulation part, in a preferred form, is made as a cylinder surface section that is bent on the connection extension, that extends convexly as a cylinder surface section from the plane of the fixed contact member and is braced on a projection of the base body. As noted above, the movable articulation part is thereby set on with a concave surface of application with equal curvature and pressed elastically by the bimetal member.

In accordance with another heat switch embodiment of the present invention preferably a set spring is provided that has less spring force than that of the bimetal member in snapping over. The set spring is connected on one side with the base body, and a free end thereof engages on the free end of the movable contact member. The set spring thereby, essentially, has the configuration of a leaf spring that engages the contact member by forms that are suitable for positive engagement (such as projections, bends, recesses, etc.). Also, preferably, the set spring is made by suitable stamping as a spring snap element. By this arrangement the advantage is achieved that the retaining force in at least one of the two switch positions is applied by the set spring, and the bimetal member only induces the switchover and otherwise is free of stress, whereby disadvantageous fatigue, that would affect the response behavior of the bimetal member, is avoided. The set spring can also constitute the bracing for the contact member that is movable with respect to the edge zone of the bimetal member. The positive force engagement of the bimetal member on the movable contact member as provided by the invention occurs directly in that the bimetal member engages on the free end of the set spring. Moreover, there is the advantageous possibility, in at least one of the two switch positions, to apply the spring force wherewith the articulation parts are pressed against each other by means of the set spring. This application of spring force may be accomplished by a biasing effect created, for example, by suitable bending.

It has also been found to be advantageous, in accordance with a preferred feature, if the bimetal member is disposed without clamping, i.e. as if it were "flying" and having only lateral guidance, the lateral guidance being effected by a switch housing and/or by projections of the base body. The set spring with the arms that are shaped on integrally or subsequently fastened on can thereby have a more or less cruciform outline. This lateral guidance feature is especially recommended when heat switches according to the invention are delivered open, for subsequent introduction into a housing.

It is noted that the heat switch according to the invention, among other things, offers the advantage that, with small dimensions, large currents can be switched. For this reason a heat switch according to the present invention is quite specifically suited for a new arrangement for overload protection of electric motors, wherein the housing of the heat switch is made as a winding cover for fixation of current windings of an electric motor in winding grooves of a stator and/or rotor as described in my copending U.S. Application Ser. No. 145,576 having the same effective filing date as this application and entitled "Electric Motor with Thermal-Protection Switch", and now abandoned.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
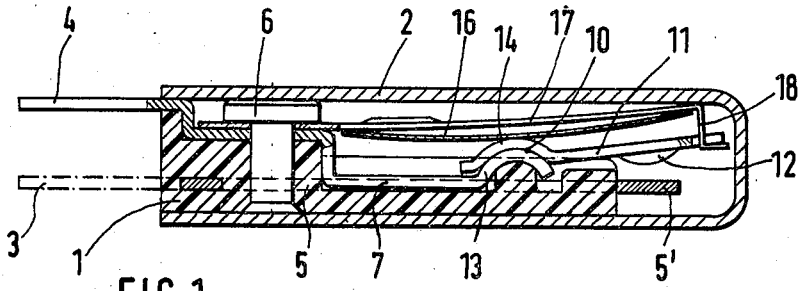
FIG. 1 shows a heat switch in longitudinal section, in a non-conducting, open position.

The heat switch illustrated in the figures comprises a base body 1, on which the actual switch mechanism is mounted, and a surrounding housing 2. On base body 1 there are fastened electrical connection elements 3, 4 that are electrically insulated from each other. The base body 1 consists of insulating material and is cast about an intermediate portion of connection element 3 so that element 3 forms a fixed contact member 5.

Connecting element 4 is connected with base body 1 by means of a rivet 6 and is formed with a unitary connection extension 7. Connection elements 3, 4 with contact member 5 and connection extension 7, respectively, are each made as one piece, from sheet parts, by bending and stamping.

Fixed contact member 5, whose outer dimensions essentially correspond to the open interior outline of the housing, presents an expanded central recess 8 through which rivet 6 passes in an electrically insulated manner. Connection extension 7 is bent into a Z configuration so that it runs, with clearance, in the plane of fixed contact member 5, within recess 8. Base body 1 presents a rib 9 running inside fixed contact 5, which rib in turn encloses connection extension 7 and therewith effects an unequivocal lateral positioning of fixed contact member 5 relative to connection extension 7.

A movable contact member 11 is connected to connection extension 7 by means of an articulated connection 10, which comprises a sheet section that is relatively stiff (resistant to bending) and supports a contact 12 near one end. The contact 12 is applied in the current-transmitting position (FIG. 2) on the forward crosspiece of fixed contact member 5. The articulated connection 10 comprises two concave or convex concentric cylindrical articulation parts 13, 14 formed at ends of extension 7 and contact member 11, respectively. The articulation parts 13, 14 are applied on each other in a rotationally slidable manner so as to be electrically conducting.

Articulation part 13 is a fixed part formed by a cylinder surface section that extends outwardly, upward convexly, from the plane of the fixed contact member 5, and is a bent portion of connection extension 7. Additionally, articulation part 13 is braced on a projection 15 of base body 1. Articulation part 14 is movable and correspondingly a bent portion of the movable contact member 11 that is applied with a correspondingly concave application surface of like curvature to that on fixed articulation part 13. Connection extension 7 and contact members 5, 11 are of a metal of high electrical conductivity such as brass and at least in the region of the current transmission places (articulation parts 13, 14, crosspiece 5' and contact 12) and they have a silver plating to reduce transmission resistance.

Actuation of movable contact member 11 is effected by a cap-shaped bimetal snap plate 16 whose base surface is constituted as a circular section that is laterally bounded by two parallel sides, and it corresponds essentially to the open interior outline of housing 2. Because of this large-area design of the bimetal snap plate 16, a temperature responsive switching is achieved that is very precise.

Additionally, a set spring 17 which is made as a spring snap element is connected with base body 1 by the rivet 6 that is also used to secure connection element 4. Set spring 17 has a bent portion 18 at its free end located opposite to that secured by the rivet 6. The bent portion 18 positively engages in a corresponding recess 19 of movable contact member 11. Bimetal snap plate 16 is disposed between set spring 17 and movable contact member 11. In the closed (FIG. 2) position of the switch, the forward (innermost) edge zone of the snap plate 16 positively and directly engages on movable contact member 11 in the vicinity of contact 12. On the other hand, in the open (FIG. 1) position, snap plate 16 acts indirectly upon movable contact 14 via set spring 17, snap plate 16 engaging set spring 17 in the vicinity of the bent portion 18 that is interengaged with movable contact member 14 and its rear edge zone is braced on set spring 17 near the area where it is clamped on base body 1 by rivet 6. In both positions, the middle zone of bimetal snap plate 16 is applied against movable articulation part 14 so that the latter is elastically pressed against the fixed articulation part 13 (by the common action of bimetal snap plate 16 and set spring 17). For stiffening purposes, set spring 17 has a corrugated impression 20 in the region adjacent its riveted connection to base body 1. Bimetal snap plate 16 is otherwise set in without clamping, is guided along its parallel edges by housing 2, and receives bearing support from ribs 9 of base body 1 at an edge zone located opposite the contact 12.

Figure 2:
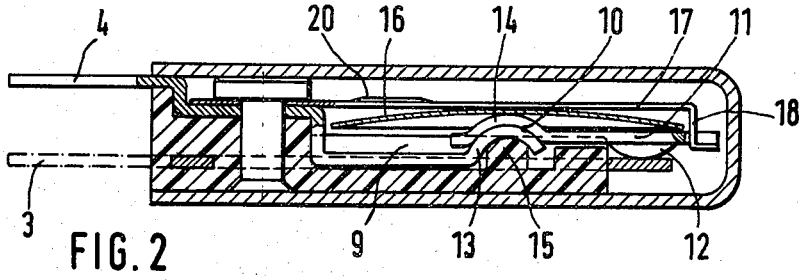
FIG. 2 shows the subject of FIG. 1 in a closed position for current transmission.

In the low temperature or current-transmitting setting shown in FIG. 2, bimetal snap plate 16 is bulged upwardly (i.e., concavely facing articulation part 14) and is applied against contact 12 of movable contact member 11 on the forward crosspiece 5' of fixed contact member 5 so that the switch is closed. In this position the pressure of application between articulation parts 13, 14 on the one hand and contact 12 and the forward crosspiece 5' on the other is effected by the set spring 17 by way of the interposed bimetal snap plate 16. To enable set spring 17 to apply a biasing force toward contact member 5, the set spring 17 is formed to have a naturally bent or curved shape that results in set spring 17 being placed in a state of pre-tension when assembled into the heat switch in the manner illustrated in FIG. 2. The bimetal snap plate 16 transmits the spring force of set spring 17 both to contact 12 and centrally to articulation connection 10, and due to pre-tension holding force exerted by set spring 17, further bracing of snap plate 16 is not necessary, which is an advantage because additional bracing would result in an undesirable effect upon the temperature response produced.

When a predetermined switching temperature is exceeded, bimetal snap plate 16 snaps over into a downwardly bulged position (i.e., convexly facing articulation part 14). This open or high-temperature position is shown in FIG. 1. With the snap-over, bimetal snap plate 16 engages the free inner end of set spring 17, bending it upwardly to thereby lift movable contact member 11 from fixed contact member 5 so that the flow of current is interrupted. The articulated connection 10 is held together in the open position by the fact that set spring 17 presses articulation parts 13, 14 against each other via bimetal snap plate 16. If the temperature to which the switch is exposed goes down below the switching temperature, bimetal snap plate 16 snaps back so that contact 12 is again pressed against crosspiece 5' of fixed contact member 5.

Figure 3:
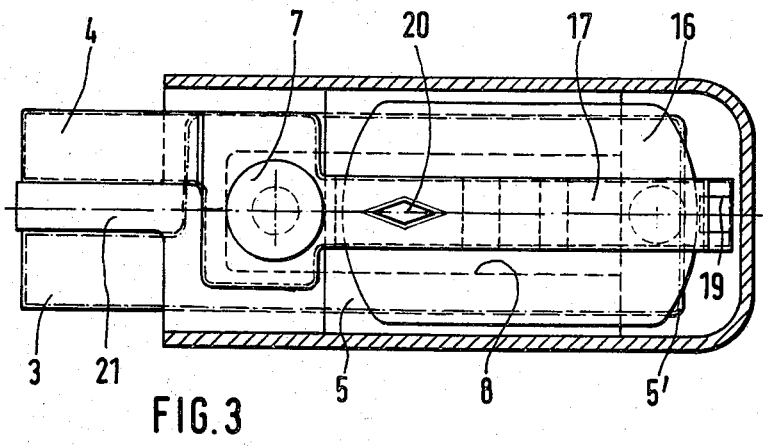
FIG. 3 shows the subject of FIGS. 1 and 2 in top view, with an open housing.
Figure 4:
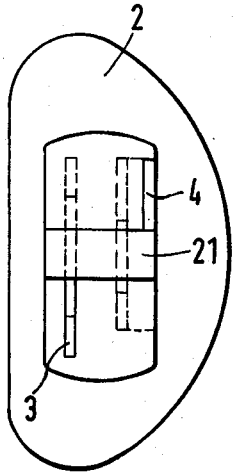
FIG. 4 shows another embodiment of a heat switch, in end view.

FIGS. 3 and 4 show the arrangement of the above-described components, in top and end views respectively. In FIG. 3, for the sake of clarity, the contours of movable contact member 11, connection extension 7, set spring 17 and the connection element 4 are indicated by dashed lines and the contours of fixed contact member 5 and its connection element 3 are indicated in dot-and-dash. Connection elements 3, 4 at the end of the base body 1 from which they extend out of the heat switch are spaced vertically and laterally from each other by an insulating partition piece 21 connected to or forming part of base body 1.

FIG. 4 also shows a special form of embodiment in which the housing 2 has the form of a wedge cover of the type that is used for fixation of windings of electric motors in the winding slots formed between pole forming lands of a rotor or stator as described in greater detail in my above-noted copending application.

The above-described heat swtich is advantageous in that it has only a small number of components that are easy to assembly and that with minimal dimensions is able to switch large currents. Another advantage attendant to use of a heat switch constructed in accordance with the present invention is that the actual switching place, i.e. the forward crosspiece 5' of the fixed contact member 5 and contact 12, is in the interior of the housing at a relatively great distance from the region where through-passages for connection elements 3, 4 and the connection are located (i.e., the right end of the switch as seen in FIGS. 1–3) so that between base body 1 and housing 2 stressing of this region by switching sparks, development of heat, etc. is reduced to a minimum.

While I have shown and described several embodiments in accordance with the present invention, it is understood that the same is not limited thereto but is susceptible to numerous changes and modifications as known to those skilled in the art and I therefore do not wish to be limited to the details shown and described herein but intend to cover all such changes and modifications as are encompassed by the scope of the appended claims.

I claim:

1. In a heat switch of the type having a base body, electrical connection elements fixed on the base body and insulated from each other, a movable contact member, a fixed contact member, and a bimetallic member for controlling the relative positions of said contact members with respect to each other, wherein each of the contact members is connected with a respective one of the electrical connection elements in an electrically conductive manner, and said bimetallic member is operable for conductively connecting or separating the contact members from each other, the improvement wherein the movable contact member is relatively resistant to bending and is connected by an electrically conducting articulated connection with one of said electrical connection elements, said articulated connection comprising an articulation part formed on said one of the connection elements and a movable articulation part formed on said movable contact member, said articulation parts being rotationally slidably and electrically conductively applied against each other and resiliently pressed toward each other by spring force.

2. Heat switch according to claim 1, wherein said articulation parts comprise a cylindrical surface section formed as part of said one of the connection elements and a mating cylindrical surface formed as part of the movable contact member.

3. Heat switch according to claim 1 or 2, wherein the bimetallic member is in positive engagement with the movable contact member and the base body forms a bearing support for an edge zone of the bimetallic member that is located opposite the movable contact member.

4. Heat switch according to claim 1 or 2, wherein the bimetallic member is braced in a mid-zone on said articulated connection.

5. Heat switch according to claim 1 or 2, wherein the fixed contact member has a plane surface and a central recess and said one of the connection elements has an inner connection extension which extends generally in the plane of the fixed contact member and inside of the recess.

6. Heat switch according to claim 5, wherein the base body has structures for positive engagement that are surrounded by the fixed contact member and that surround the connection extension.

7. Heat switch according to claim 5, wherein said fixed articulation part comprises a convex cylinder surface section formed by a bend of the connection extension that extends beyond the plane of the fixed contact member, and which is braced on a projection of the base body.

8. Heat switch according to claim 7, further comprising a set spring operable to exert a spring force on said movable contact in a first direction that is less than that exertable by said bimetallic member in an opposite direction, said set spring being connected at one end with the base body and engaged with a free end of the movable contact member at an opposite end.

9. Heat switch according to claim 1 or 2, further comprising a set spring operable to exert a spring force on said movable contact in a first direction that is less than that exertable by said bimetallic member in an opposite direction, said set spring being connected at one end with the base body and engaged with a free end of the movable contact member at an opposite end.

10. Heat switch according to claim 8, wherein the set spring is a spring snap element.

11. Heat switch according to claim 9, wherein the set spring is a spring snap element.

12. Heat switch as in claim 9, wherein the bimetallic member is engageable with a free end of the set spring.

13. Heat switch according to claim 12, wherein the set spring forms a bearing for an edge zone of the bimetallic member that is opposite the movable contact member.

14. Heat switch according to claim 8, wherein the bimetallic member is freely supported and is guided at its edges by at least one of a housing of said switch and projections of the base body.

15. Heat switch according to claim 1 or 2, wherein the bimetallic member is freely supported and is guided at its edges by at least one of a housing of said switch and projections of the base body.

16. Heat switch as in one of claims 1 or 2, comprising a surrounding housing for enclosing said heat switch, said housing being shaped in the form of a wedge cover for fixation of current windings of an electric motor, in a winding groove within which they are received.

17. Heat switch according to claim 16, wherein said housing is cylindrical in shape, having a generally planar lower wall and a generally circular sector shaped upper wall.

18. Heat switch as in claim 8 characterized in that the bimetallic member is disposed so as to be free of clamping and is guided at the edge by arms connected with the set spring.

* * * * *